US009592511B2

(12) United States Patent
Lüdke et al.

(10) Patent No.: US 9,592,511 B2
(45) Date of Patent: Mar. 14, 2017

(54) REACTION VESSEL FOR PCR DEVICE AND METHOD OF PERFORMING PCR

(75) Inventors: Gerd Lüdke, Holzgerlingen (DE); Andreas Boos, Bondorf (DE); Hassan Motejadded, Sindelfingen (DE); Johannes Bacher, Leonberg-Warmbronn (DE)

(73) Assignee: Curetis GmbH, Holzgerlingen (DE)

( * ) Notice: Subject to any disclaimer, the term of this patent is extended or adjusted under 35 U.S.C. 154(b) by 641 days.

(21) Appl. No.: 13/698,805

(22) PCT Filed: May 19, 2011

(86) PCT No.: PCT/EP2011/002507

§ 371 (c)(1),
(2), (4) Date: Jan. 24, 2013

(87) PCT Pub. No.: WO2011/144345

PCT Pub. Date: Nov. 24, 2011

(65) Prior Publication Data

US 2013/0130267 A1 May 23, 2013

(30) Foreign Application Priority Data

May 19, 2010 (EP) ..... 10005237

(51) Int. Cl.
*B01L 7/00* (2006.01)
*B01L 3/00* (2006.01)

(52) U.S. Cl.
CPC ..... *B01L 7/52* (2013.01); *B01L 3/502* (2013.01); *B01L 2200/0631* (2013.01);
(Continued)

(58) Field of Classification Search
None
See application file for complete search history.

(56) References Cited

U.S. PATENT DOCUMENTS 5,976,824 A * 11/1999 Gordon ..... 435/29
6,110,428 A * 8/2000 Borst ..... B01D 15/00 422/534

(Continued)

FOREIGN PATENT DOCUMENTS

CN 1338522 A 3/2002
CN 101341405 A 1/2009

(Continued)

*Primary Examiner* — Stephanie K Mummert
(74) *Attorney, Agent, or Firm* — Olson & Cepuritis, Ltd.

(57) ABSTRACT

The present invention provides a reaction vessel (20) for a PCR device. The reaction vessel (20) comprises a sample vial (32) defining a reaction chamber (33) for performing PCR and a storage vessel (62) defining a storage chamber (63) for optical detection. The reaction chamber (33) is in fluid communication with a liquid supply port (34) for supplying a liquid sample containing at least one target DNA to the reaction chamber (33). The reaction chamber (33) and the storage chamber (63) are in fluid communication via a spacer element (42) and a porous membrane (51) for hybridization of the at least one target DNA within the liquid sample onto specific immobilised hybridization probes. The lower end of the spacer element (42) extends into the reaction chamber (33), but does not reach the bottom thereof. The upper end of the spacer element (42) is located in proximity of the porous membrane (51), which is made from a material having different physical properties in a dry state and a wet state. In the dry state the porous membrane (51) allows air as well as liquid to pass therethrough. In the wet state the porous membrane (51) still allows the passage of liquid therethrough, but not of air, such that during a PCR the liquid sample remains in the reaction chamber (33) and after the PCR the reaction vessel (20) is configured to force the liquid sample via the spacer element (42) to the porous membrane (51) for hybridization and detection of the at least one target DNA in the liquid sample. Moreover, a PCR (Continued)

device comprising such a reaction vessel (20) as well as a method for performing PCR are described.

15 Claims, 8 Drawing Sheets

(52) U.S. Cl.
CPC ..... *B01L 2200/10* (2013.01); *B01L 2300/047* (2013.01); *B01L 2300/0636* (2013.01); *B01L 2300/0681* (2013.01); *B01L 2300/087* (2013.01); *B01L 2400/049* (2013.01); *B01L 2400/0487* (2013.01)

(56) References Cited

U.S. PATENT DOCUMENTS

| | | | | |
|---|---|---|---|---|
| 2002/0137066 | A1 | 9/2002 | Kajiyama et al. | |
| 2003/0129614 | A1 | 7/2003 | Parameswaran et al. | |
| 2005/0170401 | A1 | 8/2005 | Sugiyama | |
| 2008/0300144 | A1* | 12/2008 | Bacher et al. | 506/9 |
| 2009/0325164 | A1 | 12/2009 | Vossenaar et al. | |
| 2010/0331522 | A1* | 12/2010 | Irvine | C07H 1/06 530/344 |

FOREIGN PATENT DOCUMENTS

| | | | |
|---|---|---|---|
| EP | 1769848 | A2 | 4/2007 |
| EP | 1845374 | A1 | 10/2007 |
| WO | 2007/072311 | A2 | 6/2007 |

* cited by examiner

REACTION VESSEL FOR PCR DEVICE AND METHOD OF PERFORMING PCR

CROSS-REFERENCE TO RELATED APPLICATIONS

This application is a U.S National Stage of PCT/EP2011/002507, filed May 19,2011, which claims priority of European Patent application No. 10005237.1, filed May 19, 2010, each of which is incorporated herein by reference.

TECHNICAL FIELD OF THE INVENTION

The invention relates to a reaction vessel for a PCR device, a PCR device including such a reaction vessel and a method of performing PCR including the detection of the amplified PCR products.

BACKGROUND OF THE INVENTION

Genetic examinations by analysis of nucleic acids are widely employed for medical, research, and industrial applications with recent progress in technologies of genetic manipulation, genetic recombination, and the like. These examinations involve the detection and quantification of the presence of a target nucleic acid having a target nucleotide sequence in a sample, and are applied in various fields, not only in the diagnoses and treatment of diseases, but also in examination of food. For example, genetic examinations for detecting congenital or acquired mutant genes, virus-related genes, and others are carried out for diagnosis of diseases, such as genetic diseases, tumors, and infections. Analysis of genetic polymorphisms, including single nucleotide polymorphism (SNP), is also applied not only to clinical examinations and academic research, but also to quality checks and traceability of foods and others.

Samples which are subject to gene analysis are often available only in trace amounts, like specimens in forensic or clinical examinations. For this reason, genome fragments containing a target nucleic acid are usually amplified in advance and the amplified genome fragments are employed to detect and quantify the target nucleic acid. Often, the amplification of the target nucleic acid is performed by means of the Polymerase Chain Reaction (PCR).

By means of PCR it is possible to amplify a single or a few copies of a piece of DNA across several orders of magnitude, generating thousands to millions of copies of a particular DNA sequence. The method relies on thermal cycling, consisting of cycles of repeated heating and cooling of the reaction for DNA melting and enzymatic replication of the DNA. These thermal cycling steps are necessary first to physically separate the two strands in a DNA double helix at a high temperature in a process called DNA melting. At a lower temperature, each strand is then used as the template in DNA synthesis by the DNA polymerase to selectively amplify the target DNA. Primers (short DNA fragments) containing sequences complementary to the target region along with a DNA polymerase (after which the method is named) are key components to enable selective and repeated amplification. As PCR progresses, the DNA generated is itself used as a template for replication, setting in motion a chain reaction in which the DNA template is exponentially amplified.

PCR is often used in the form of real-time PCR, where amplification and detection are closely coupled. Several devices for real-time PCR are commercially available, such as "Roche Light Cycler", "Cepheid Smart Cycler", and the like. An alternative to real-time PCR is standard or endpoint PCR where the detection step follows after the completion of the PCR. When using standard or endpoint PCR, detection of amplified DNA is generally performed by gel electrophoresis, capillary electrophoresis, capillary gel electrophoresis or hybridization on dot blots or microarrays.

For a number of diagnostic applications, sensitive and simultaneous measurements of the presence of a number of different specific DNA target sequences are required. Although real-time PCR meets these requirements for a few specific parameters, it does not allow the measurement of a large number of analytes simultaneously within the same reaction due to the limited amount of different available fluorescent dyes and technical difficulties with detectors for more than four different fluorescent dyes. Currently available instruments allow the simultaneous detection of at most four different DNA target sequences within one reaction when using real-time PCR. The combination of a standard or endpoint PCR with a subsequent hybridization reaction does allow the simultaneous analysis of a larger number of analytes, but requires handling of the amplified DNA target sequences within the liquid sample which greatly increases the risk of sample cross contamination.

Thus, the object of the present invention is to provide a reaction vessel for a PCR device, a PCR device including such a reaction vessel and a method for performing PCR including detection of the amplified PCR products that overcome the above described drawbacks of conventional PCR devices and methods.

SUMMARY OF THE INVENTION

The above object is achieved by a reaction vessel for a PCR device, a PCR device including such a reaction vessel and a method for performing PCR including detection of the amplified PCR products according to the independent claims. The present invention overcomes the limitations of conventional PCR devices and methods by performing the amplification and hybridization reactions at spatially separated locations of a closed reaction vessel not prone to cross-contamination so that the higher multiplex grades of endpoint PCR can be advantageously employed.

This is achieved by configuring the reaction vessel such that a reaction chamber for performing PCR and a storage or detection chamber are separated by means of a porous membrane configured to effect or to perform hybridization. The reaction chamber is preferably in fluid communication with a liquid supply port for supplying a liquid sample containing at least one target DNA to be amplified to the reaction chamber. The reaction chamber and the storage chamber are in fluid communication via a fluid channel defined by a spacer element and the porous membrane for hybridization of the amplified target DNA within the liquid sample onto specific hybridization or capture probes immobilised on the porous membrane. The lower end of the spacer element extends into the reaction chamber, but does preferably not reach the bottom thereof. The upper end of the spacer element is preferably located close to and, preferably, in abutting relationship with the porous membrane containing the immobilised hybridization probes. The porous membrane is made from a material having different properties in a dry state and a wet state. In the dry state the porous membrane allows air as well as liquid to pass therethrough. In the wet state at pressures below the bubble point pressure the porous membrane still allows the passage of liquid therethrough, but not of air. During a PCR, the liquid sample preferably remains in the reaction chamber. Thereafter, the reaction vessel is configured to force the liquid sample via the fluid channel defined by the spacer element through the porous membrane into the storage chamber for hybridization and detection of the amplified target DNA within the liquid sample.

Preferably, the reaction vessel is configured such that during a PCR the liquid sample remains in the reaction chamber and after the PCR the liquid sample can be forced via the spacer element through the porous membrane for hybridization and subsequent detection of the at least one target DNA in the liquid sample.

Preferably, the reaction vessel is configured to provide an overpressure in the storage chamber and a vacuum or an underpressure in the reaction chamber, or to provide a vacuum or an underpressure in the storage chamber and an overpressure in the reaction chamber, or, for example, to provide an overpressure in the storage chamber at ambient pressure in the reaction chamber, or to provide a vacuum or an underpressure in the storage chamber at ambient pressure in the reaction chamber, to move at least the liquid sample and/or a hybridization buffer and/or another liquid agent at least once, preferably at least five times, and most preferably at least ten times back and forth through the porous membrane while remaining in contact therewith. That is, such a pressure differential has to be provided that allows for the movement of at least the liquid sample in a desired manner.

Preferably, the lower end of the spacer element extends into the reaction chamber, but does not reach the bottom thereof, and wherein the upper end of the spacer element is located in close proximity of and preferably in abutting relationship with the porous membrane.

Preferably, the distance between the lower end of the spacer element and the bottom of the reaction chamber is between 0.1 and 0.5 cm.

Preferably, the porous membrane comprises a nylon material.

Preferably, the reaction chamber is defined by a sample vial provided as part of a bottom element and/or the storage chamber is defined by a storage vessel provided as part of a top element.

Preferably, a center element is provided, which is arranged or which is configured to be arranged between the top element and the bottom element, and wherein the center element preferably comprises the spacer element.

Preferably, the reaction chamber is in fluid communication with a liquid supply port for supplying the liquid sample containing at least one target DNA to the reaction chamber.

Preferably, the liquid supply port is connected with the reaction chamber by means of a first groove.

Preferably, at least one guide member is provided, which is configured to guide the liquid sample supplied by the liquid supply port into the reaction chamber.

Preferably, two guide members are arranged at the spacer element, preferably at the upper end of the spacer element, such that the liquid from the first groove is guided into the reaction chamber, and is prevented from further flowing along the upper end of the spacer element.

According to a further aspect the present invention provides a cartridge for a PCR device, comprising:

a plurality of reaction vessels as described above; and/or a plurality of individually controllable fluid channels in respective fluid communication with the plurality of reaction vessels for supplying liquid samples to a plurality of reaction vessels.

According to a further aspect the present invention provides for a PCR device comprising at least one reaction vessel as described above.

According to a yet further aspect the present invention provides for a method for performing PCR including the detection of the amplified PCR products using a reaction vessel as described above.

Additional preferred embodiments, advantages and features of the present invention are defined in the dependent claims and/or will become apparent by reference to the following detailed description and the accompanying drawings.

DETAILED DESCRIPTION OF PREFERRED EMBODIMENTS

The present invention will now be further described by defining different aspects of the invention generally outlined above in more detail. Each aspect so defined may be combined with any other aspect or aspects unless clearly indicated to the contrary. In particular, any feature indicated as being preferred or advantageous may be combined with any other feature or features indicated as being preferred or advantageous.

The term "sample" as used herein includes any reagents, solids, liquids, and/or gases. Exemplary samples may comprise anything capable of being thermally cycled.

The term "nucleic acid" as used herein refers to a polymer of two or more modified and/or unmodified deoxyribonucleotides or ribonucleotides, either in the form of a separate fragment or as a component of a larger construction. Examples of polynucleotides include, but are not limited to, DNA, RNA, or DNA analogs such as PNA (peptide nucleic acid), and any chemical modifications thereof The DNA may be a single- or double-stranded DNA, cDNA, or a DNA amplified by any amplification technique. The RNA may be mRNA, rRNA, tRNA, a ribozyme, or any RNA polymer.

The terms "target nucleic acid sequence" or "target nucleic acid" or "target" as used herein refers to the nucleic acid that is to be captured, detected, amplified, manipulated and/or analyzed. The target nucleic acid can be present in a purified, partially purified or unpurified state in the sample.

The term "primer" molecule as used herein refers to a nucleic acid sequence, complementary to a known portion of the target sequence/control sequence, necessary to initiate synthesis by DNA or other polymerases, RNA polymerases, reverse transcriptases, or other nucleic acid dependent enzymes.

Figure 1:
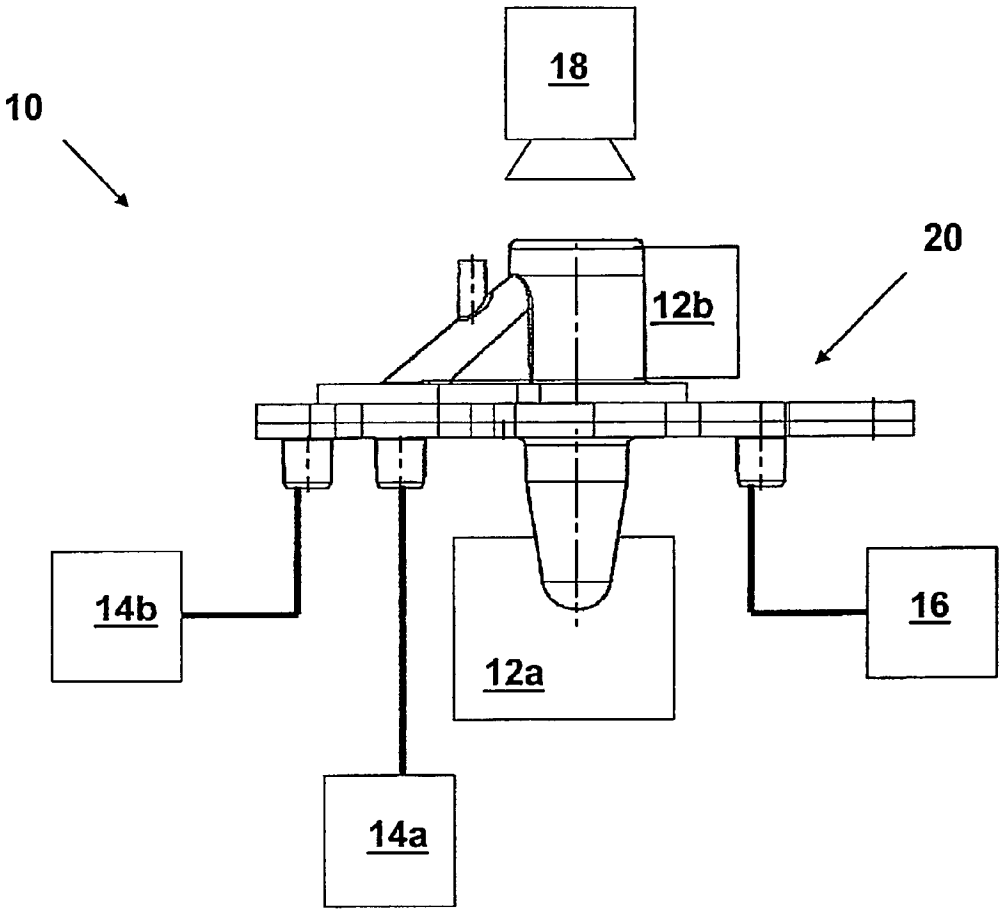
FIG. 1 shows a schematic representation of a PCR device according to the present invention including a preferred embodiment of a reaction vessel.

FIG. 1 shows schematically and not to scale the main components of a PCR device 10 according to a preferred embodiment of the present invention. At the heart of the PCR device 10 is a reaction vessel 20 for performing PCR and allowing detection of the amplified PCR products that will be described in more detail in the context of FIGS. 2*a* to 2*d* and 3*a* to 3*c*. Generally speaking, in addition to the reaction vessel 20 the PCR device 10 comprises heating and/or cooling means 12*a*, 12*b*, such as resistive heating means and/or convective cooling means, for heating and/or cooling a reaction chamber 33 and a storage chamber 63 of the reaction vessel 20 (cf. FIGS. 2*a*-2*d*), pressure supply means 14*a*, 14*b* for providing a pressure differential between a first pressure port 35 in fluid communication with the reaction chamber 33 and a second pressure port 36 in fluid communication with the storage chamber 63 of the reaction vessel 20, liquid supply means 16 for supplying sample and/or a reaction liquid to the reaction chamber 33 of the reaction vessel 20 via a liquid supply port 34 thereof and optical excitation and detection means 18, such as a light source (Laser, LED or the like) and a CCD or CMOS detector including appropriate optical elements, for optical excitation and interrogation of a porous hybridization membrane 51 of the reaction vessel 20, preferably by means of epifluorescence. The functions of these different components of the PCR device 10 and their mutual interaction will become clearer in the context of the following detailed description of the reaction vessel 20 according to a preferred embodiment of the present invention.

Figure 2B:
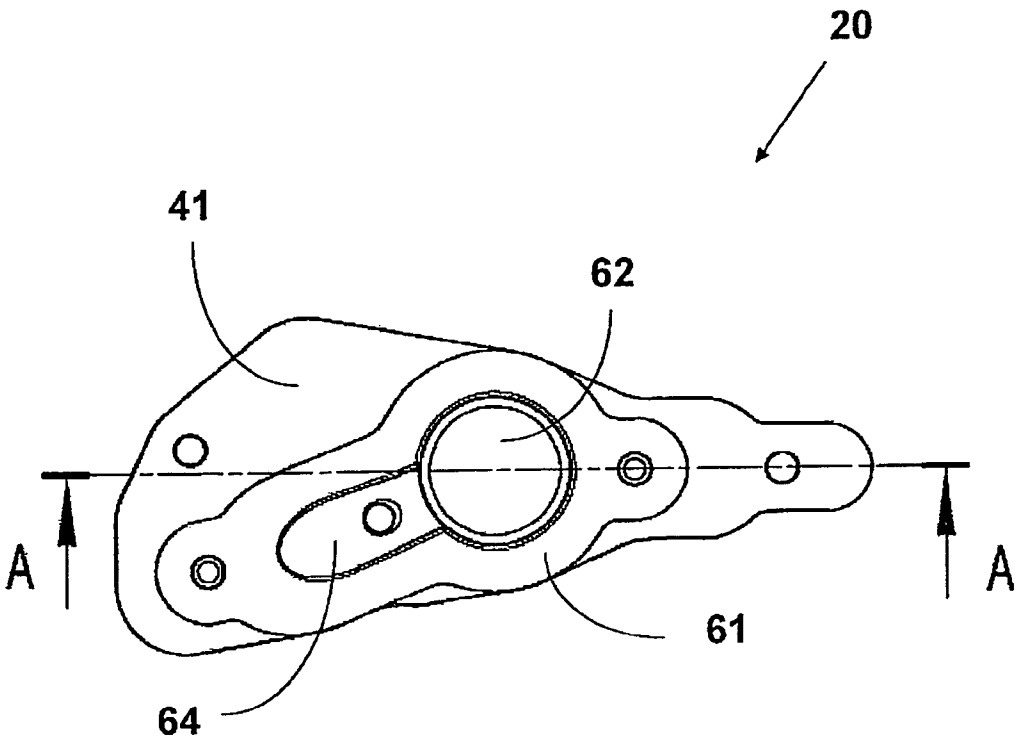
FIGS. 2*a* to 2*d* show different views of the reaction vessel according to the preferred embodiment of the present invention.
Figure 2A:
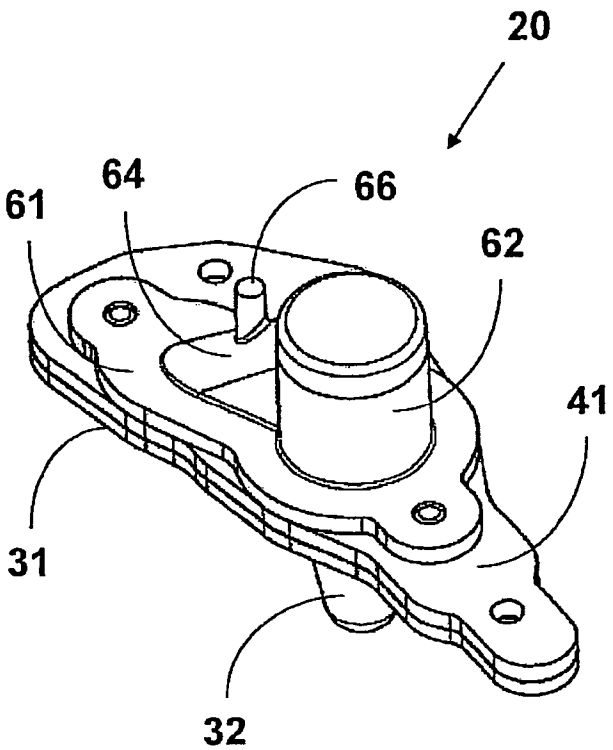
Figure 2C:
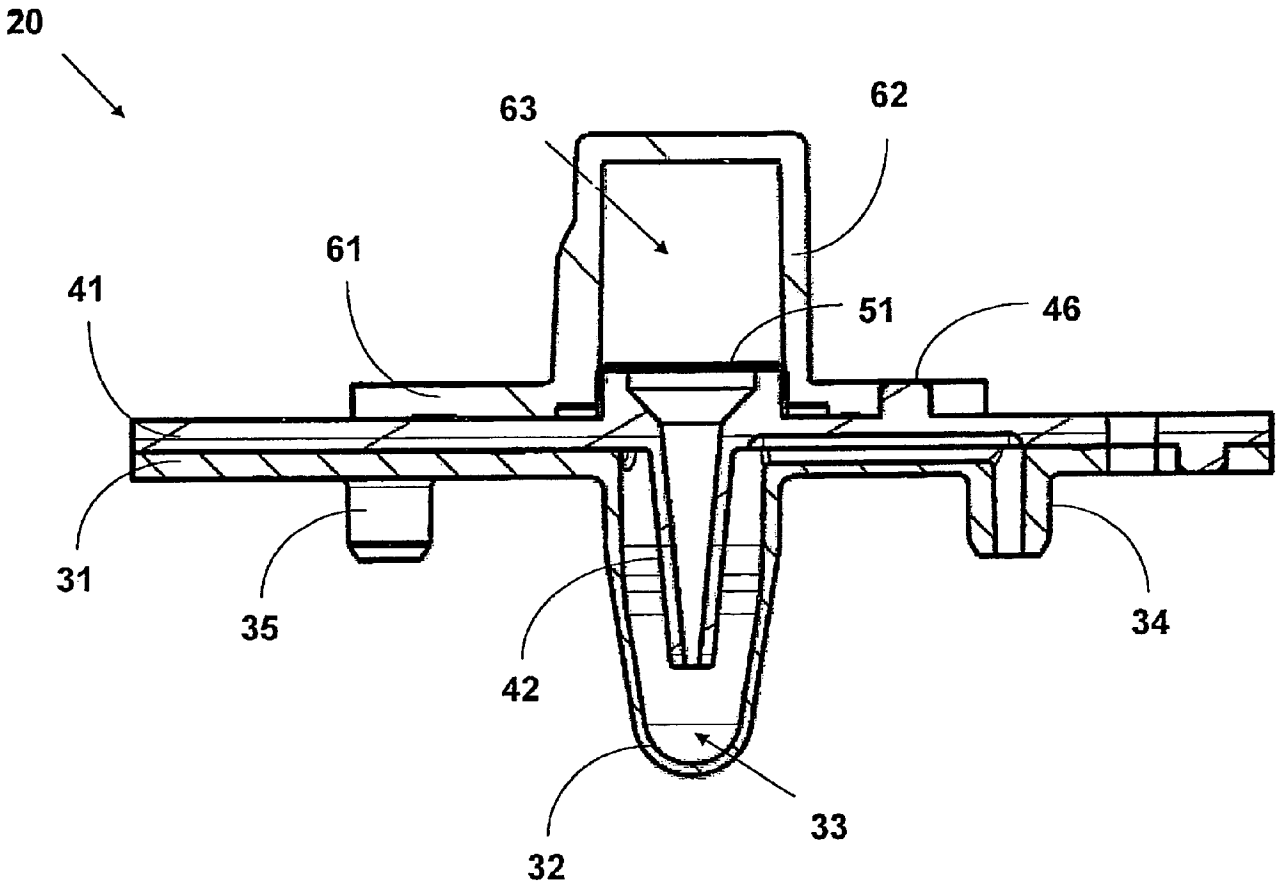
Figure 2D:
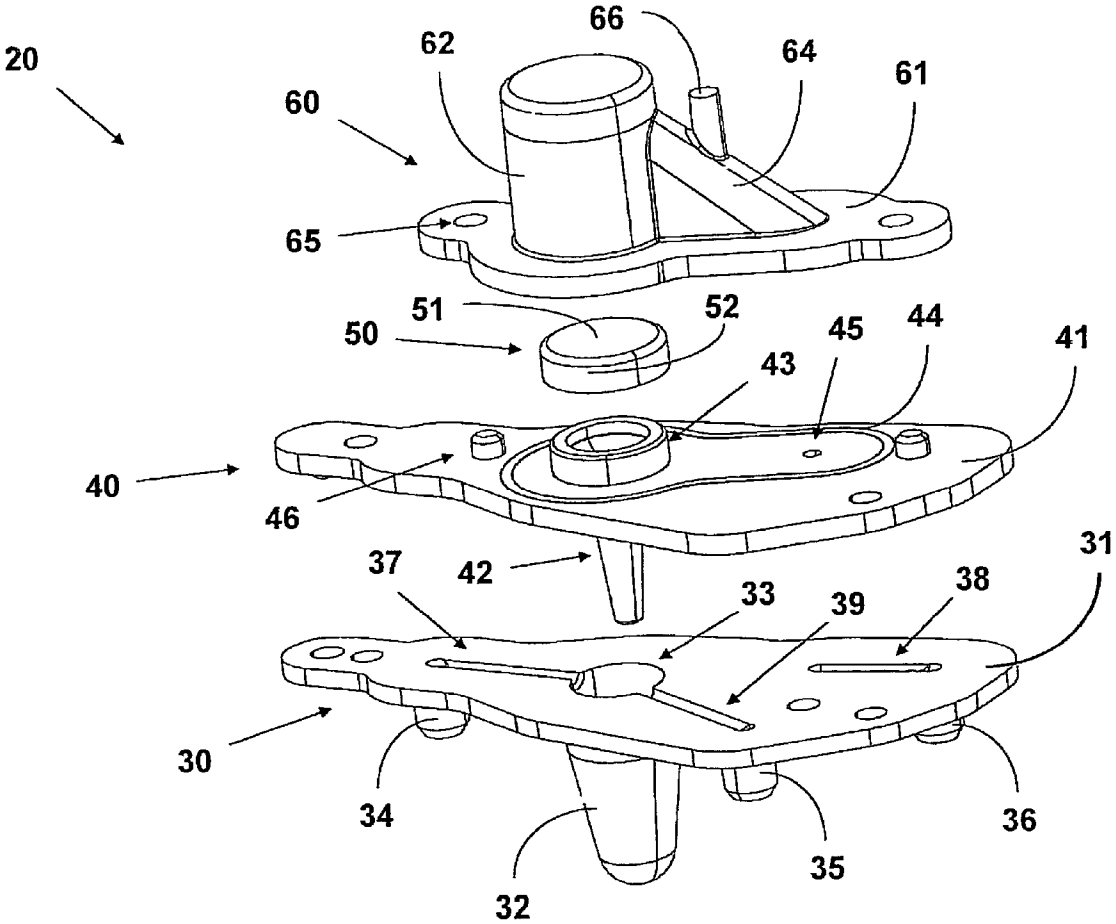

FIGS. 2*a* and 2*b* show a perspective view and a top view of the reaction vessel 20 according to the preferred embodiment of the present invention. A cross-sectional view along the line A-A of FIG. 2*b* and an exploded view of the reaction vessel 20 are shown in FIGS. 2*c* and 2*d*, respectively. According to a preferred embodiment or preferably, the reaction vessel 20 is made up of four main elements (see FIG. 2*d*), namely a bottom element 30, a center element 40, a membrane element 50, and a top element 60. Preferably, the bottom element 30, the center element 40, and the top element 60 are produced by injection molding techniques and made of a plastic material, most preferably from polycarbonate. In order to suppress stray light the bottom element 30 and/or the center element 40 can further include an opaque material, such as carbon black. The person skilled in the art will appreciate that the reaction vessel 20 could be made as a unitary piece as well.

The bottom element 30, the center element 40, and the top element 60 each have a substantially plane support plate, namely support plate 31, support plate 41, and support plate 61, respectively. These support plates 31, 41, 61 are sized and configured such that at least part of the support plate 41 of the center element is sandwiched between the support plate 31 of the bottom element 30 and the support plate 61 of the top element 60. Several assembly pins and complimentary shaped assembly holes are provided on and in the support plates 31, 41, 61 that allow for a stable assembly of the bottom element 30, the center element 40, and the top element 60 to provide for the reaction vessel 20. In FIGS. 2*c* and 2*d* an assembly pin provided on the support plate 41 of the center element 40 has been exemplary given the reference sign 46 and a complimentary shaped assembly hole provided in the support plate 61 of the top element 60 has been exemplary given the reference sign 65. Preferably, the bottom element 30, the center element 40, and the top element 60 are bonded together by means of a welding technique, such as laser welding, ultrasound welding, high frequency welding and the like. Alternatively, the bottom element 30, the center element 40, and the top element 60 could be bonded together by means of an adhesive or the like. As a further alternative, in some case the snug engagement between the assembly pins and the complimentary shaped assembly holes provided in the support plates 31, 41, 61 might be sufficient to provide for the required stability and pressure resistance of the reaction vessel 20.

Substantially in the center of the support plate 31 of the bottom element 30 a sample vial 32 projects downwards from the bottom surface of the support plate 31 such that the reaction chamber 33 is defined by the inner surface of the sample vial 32. As can be taken from FIG. 2*c*, according to a preferred embodiment of the present invention or preferably, a top portion of the sample vial 32 has a cylindrical shape, a middle portion has a conical shape and a bottom portion has a hemispherical shape. Grooves 37 and 39 (first and third groove) are provided in the top surface of the support plate 31 of the bottom element 30 that connect the reaction chamber 33 with a liquid supply port 34 and a first pressure port 35 disposed on the bottom surface of the support plate 31 of the bottom element 30. A further (second) groove 38 is provided in the top surface of the support plate 31 of the bottom element 30 that is in fluid communication with a second pressure port 36 also disposed on the bottom surface of the support plate 31 of the bottom element 30. As already mentioned above in the context of FIG. 1, by means of appropriate fluid connections the liquid supply port 34 is connected to liquid supply means 16 and the first and second pressure ports 35 and 36 are connected to pressure supply means 14*a*, 14*b*. As the person skilled in the art will appreciate, these fluid connections might further include respective fluid valves to allow for a controlled movement of fluids, i.e. liquids or gases, into and out of the reaction vessel 20.

Substantially in the center of the support plate 41 of the center element 40 a spacer element 42 projects downwards from the bottom surface of the support plate 41 such that the spacer element 42 extends into the reaction chamber 33 defined by the sample vial 32 of the bottom element 30. The spacer element 42, however, does not extend all the way to the bottom of the reaction chamber 33. Rather, there remains a distance (corresponding to a certain volume) between the lower end of the spacer element 42 and the bottom of the reaction chamber 33 (see in particular FIG. 2*c*). The spacer element defines an internal fluid channel and advantageously has a nozzle-like shape. The person skilled in the art, however, will appreciate that the spacer element 42 could have a cylindrical tube-like shape as well.

According to a preferred embodiment or preferably, the distance between the lower end of the spacer element 42 and the bottom of the reaction chamber 33 is in the range from 0.1 to 0.5 cm, most preferably about 0.25 cm. This most preferred distance preferably corresponds to a volume between the lower end of the spacer element 42 and the bottom of the reaction chamber 33 of about 35 μl. As the person skilled in the art will further appreciate from the below, during a PCR the volume of the liquid sample should be chosen according to the present invention such that the liquid sample within the reaction chamber 33 does not come into contact with the lower end of the spacer element 42 during the PCR taking into account any thermal expansions of the liquid sample at the maximum temperatures reached during the PCR. According to a further preferred embodiment of the present invention or preferably, the volume defined by the internal fluid channel of the spacer element 42 is smaller than the volume between the lower end of the spacer element 42 and the bottom of the reaction chamber 33.

The internal fluid channel defined by the spacer element 42 is in fluid communication with a preferably funnel-shaped fluid channel defined by the inner surface of a membrane support 43 that projects upwards from the top surface of the support plate 41 (see FIGS. 2*c* and 2*d*). The membrane support 43 preferably has a substantially cylindrically shaped outer surface and is configured to receive and retain the membrane element 50. A pressure through-hole 45 is provided in the support plate 41 of the center element 40 for fluid communication with the second groove 38 and the second pressure port 36 of the bottom element 30. Optionally, a sealing element 44, such as a gasket, can be provided on the top surface of the support plate 41 that encircles the membrane support 43 and the pressure through-hole 45 for providing a fluid-tight sealing. The person skilled in the art will readily appreciate, however, that no sealing element at all or two or more separate sealing elements could be used as well.

The membrane element 50 is arranged on the membrane support 43 provided on the top surface of the support plate 41 of the center element 40. The membrane element 50 comprises a substantially circular porous membrane 51 and a membrane support skirt 52 connected to the porous membrane 51 and shaped to fit snugly onto the cylindrically shaped outer surface of the membrane support 43 of the center element 40. According to an alternative embodiment, the porous membrane 51 can form the whole membrane element 50 that is clamped between the outer cylindrical surface of the membrane support 43 and the inner cylindrical surface of a storage vessel 62 of the top element 60, as will be described in more detail further below. Preferably, the porous membrane 51 is a nylon membrane, such as the nylon membrane "Nytran SPC" supplied by the company Whatman plc, Maidstone, Kent, UK. Preferably, a plurality of different hybridization probes complementary to the target DNA is immobilised on the porous membrane 51. As the person skilled in the art will appreciate, the porous membrane 51 can be equipped with such hybridization probes, for instance, by means of inkjet printing techniques and the hybridization probes can be immobilised, for instance, by means of UV cross-linking. Such methods are well known to the person skilled in the art and, thus, will not be described in greater detail herein.

The top element 60 is arranged and appropriately aligned on top of the center element 40 and the membrane element 50, such as by means of the assembly pin 46 provided on the top surface of the support plate 41 of the center element 40 and the assembly hole 65 provided in the support plate 61 of the top element 60. A cylindrical transparent storage vessel 62 projects upwards from the top surface of the support plate 61 of the top element 60 to define the storage or detection chamber 63 such that the storage chamber 63 is in fluid communication with the reaction chamber 33 via the spacer element 42 and the porous membrane 51. A fluid channel defined by a connection element 64 arranged between one side of the storage vessel 62 and the top surface of the support plate 61 provides for fluid communication between the storage chamber 63 and the second pressure port 36 via the pressure through-hole 45 and the groove 38. As will be described in more detail further below, by forcing or pumping preferably air via the second pressure port 36 into or out of the storage chamber 63 it is possible to control the motion of air and/or liquids within the reaction chamber 33 and the storage chamber 63. A reference element 66 can be provided on the outer surface of the top element 60 to serve as a reference point for the optical excitation and detection means 18.

Having described the main structural features of the reaction vessel 20 according to the present invention and the PCR device 10 including the reaction vessel 20, the below will describe under further reference to FIGS. 3*a* to 3*c* the function of these devices during a PCR and the subsequent detection steps. In order to perform a PCR with the PCR device 10 and its reaction vessel 20 according to the present invention a liquid sample is supplied from the liquid supply means 16 to the reaction chamber 33 via the liquid supply port 34 and the first groove 37. The liquid sample should contain in addition to at least one target DNA to be amplified at least one fluorescent primer for allowing optical detection of the amplified target DNA after having been hybridized on the membrane 51, as will be described in more detail further below. Alternatively, fluorescent primers could be provided, for instance, in dried form in the reaction chamber 33 prior to the introduction of the liquid sample (and possibly further reaction liquids) into the reaction chamber 33. Suitable fluorescent primers are well known to the person skilled in the art and, thus, will not be described in greater detail herein.

As already mentioned above, the chosen volume of the liquid sample is preferably chosen such that the liquid sample in the reaction chamber 33 does not come into contact with the lower end of the spacer element 42 extending into the reaction chamber 33. Once the liquid sample is located in the reaction chamber 33 a plurality of thermal cycling steps can be effected by the heating and/or cooling means 12*a* in thermal communication with the sample vial 32. According to a preferred embodiment of the present invention or preferably, the heating and/or cooling means 12*a* are provided by a thermal block with at least one well for receiving the lower portion of the sample vial 32. To this end the shape of the recess defined by the well of the thermal block is preferably complimentary to the shape of the sample vial 32, as is well know to the person skilled in the art.

Figure 3C:
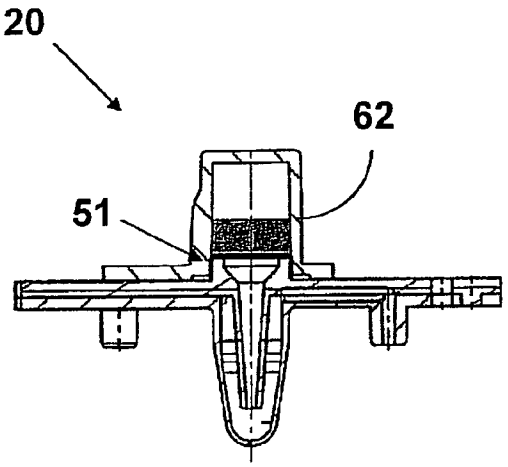
FIGS. 3*a* to 3*c* show cross-sectional views of the preferred embodiment of a reaction vessel according to FIGS. 2*a* to 2*d* at different stages of a method for performing PCR and detecting the amplified PCR products according to the present invention.
Figure 3B:
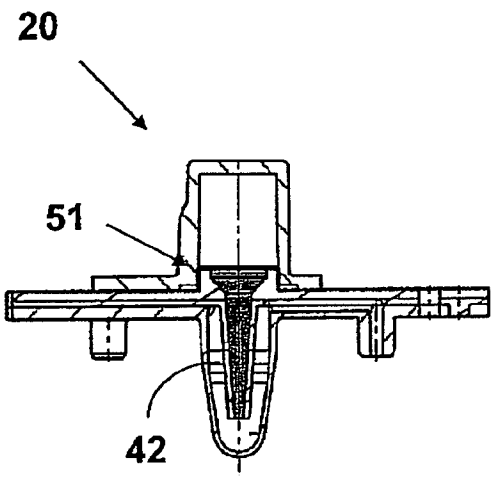
Figure 3A:
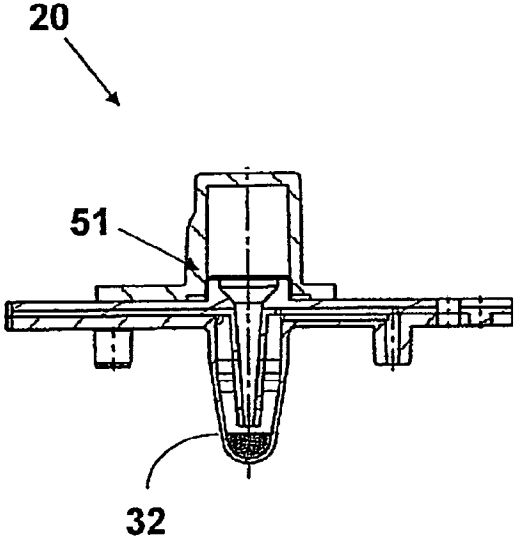

During the thermocycling process, the liquid sample remains at its position within the reaction chamber 33 defined by the sample vial 32, as schematically shown in FIG. 3*a*. As already mentioned above, this is preferably achieved by choosing the volume of the liquid sample such that the sample liquid within the reaction chamber 33 does not come into contact with the lower end of the spacer element 42 taking into account any thermal expansions of the liquid sample at the maximum temperatures of up to 96° C. or more reached during the PCR. According to a preferred embodiment or preferably, the porous hybridization membrane 51 is heated during the PCR to a temperature of at least 80° C., or more preferred about 100° C. or more, such as by means of the heating and/or cooling means 12*b*, in order to keep the porous membrane 51 dry.

Preferably, after the PCR has been completed, a hybridization buffer and/or another liquid agent is added from the liquid supply means 16 to the reaction chamber 33 via the liquid supply port 34 and the groove 37 until the mixture of liquid sample and hybridization buffer in the reaction chamber 33 comes into contact with and, preferably, submerses the lower end of the spacer element 42. Thus, according to a preferred embodiment or preferably, after the addition of hybridization buffer, the volume of the mixture of the liquid sample and the hybridization buffer in the reaction chamber 33 is larger than about 35 μl. As the person skilled in the art is well aware of, an appropriate hybridization buffer can reduce hybridization times while minimizing background and maintaining a strong signal from hybridization probes.

The person skilled in the art will appreciate that when the mixture of liquid sample and hybridization buffer submerses the lower end of the spacer element 42 the air above the liquid level within the reaction chamber 33 (i.e. outside of the spacer element 42) is no longer in communication with the air above the liquid level inside of the spacer element 42 because of the mixture of liquid sample and hybridization buffer in between. Only during the PCR, i.e. when the liquid sample does not come into contact with the lower end of the spacer element 42, the air within the reaction chamber 33 and outside of the spacer element 42 can directly communicate with any air inside of the spacer element 42.

When the mixture of liquid sample and hybridization buffer submerses the lower end of the spacer element 42 a vacuum or an underpressure can be applied to the storage chamber 63 and/or an overpressure can be applied to the reaction chamber 33 by means of a suitable control of the pressure supply means 14*a* and/or the pressure supply means 14*b*. Due to this pressure differential between the first pressure port 35 and the second pressure port 36 the mixture of liquid sample and hybridization buffer is moved from the reaction chamber 33 trough the spacer element 42, the lower end of which is submersed in the mixture of liquid sample and hybridization buffer, towards the porous hybridization membrane 51. This stage of the method according to the present invention is schematically shown in FIG. 3*b*.

In order for the mixture of liquid sample and hybridization buffer to be able to migrate through the spacer element 42 towards the porous membrane 51 it is necessary that any air trapped between the upper level of the mixture of liquid sample and hybridization buffer within the spacer element 42 and the porous membrane 51 can vent through the membrane 51. In other words, during this stage of the method according to the present invention the porous membrane 51 must be air-permeable at least to a certain degree. To ensure that the air-permeability of the porous membrane 51 is not negatively affected by becoming moist or wet during the PCR the membrane 51 is, preferably, heated to a temperature of at least 80° C. and preferably at least about 100° C. or more during the PCR, such as by means of the heating and/or cooling means 12*b*.

The mixture of liquid sample and hybridization buffer coming into contact with the porous membrane 51 has two important effects that are synergistically used in accordance with the present invention. First, at least some of the amplified target DNA containing a fluorescent primer will respectively bind to those hybridization probes provided on the porous membrane 51 having a complimentary structure to that of the target DNA and, thus, can be detected by means of the optical excitation and detection means 18, such as an appropriate light source and a CCD or CMOS detector including appropriate optical elements, preferably by means of epifluorescence techniques. Second, the mixture of liquid sample and hybridization buffer will wet the material of the porous membrane 51, preferably nylon, and affect its physical properties in that liquid will begin to fill and eventually effectively block the pores of the porous membrane 51. As the person skilled in the art is aware of, due to capillary forces for a given liquid and pore size with a constant wetting, the pressure required to force an air bubble through a pore is inversely proportional to the size of the pore. A corresponding bubble-point test is described in ASTM Method F316. At pressures below the bubble point pressure, air passes through the membrane only by diffusion, but when the pressure is large enough to dislodge liquid from the pores, i.e. at pressures above the bubble point pressure, bulk flow of air begins and air bubbles will be seen.

According to a preferred embodiment of the present invention or preferably, a pressure below the bubble point pressure of the porous membrane 51 is used to move the mixture of liquid sample and hybridization buffer through the porous membrane 51 until the mixture of liquid sample and hybridization buffer is located in the storage chamber 63, i.e. above the porous membrane 51, as schematically shown in FIG. 3*c*. Preferably, pressures below 1.4 bar, more preferably in the range from 50 to 250 mbar and most preferred in the range from 100 to 200 mbar are used to move the mixture of liquid sample and hybridization buffer upwards through the porous membrane 51. Depending on the exact geometry of the reaction vessel 10 air bubbles may start to develop at pressures of more than 1.4 bar.

It is important to appreciate that due to the above described different physical behaviour of the porous membrane 51 in its dry and wet states the mixture of liquid sample and hybridization buffer will remain in contact with the porous membrane 51 (unless a pressure higher than the bubble point pressure is used). In other words, the mixture of liquid sample and hybridization buffer so to say will stick to the porous membrane 51. This offers the advantageous possibility to move or pump the mixture of liquid sample and hybridization buffer from the position shown in FIG. 3*c*, i.e. in the storage chamber 63, through the membrane 51 back into the position shown in FIG. 3*b*, i.e. into the internal fluid channel defined by the spacer element 42, by providing an overpressure in the storage chamber 63 and/or a vacuum or an underpressure in the reaction chamber 33. However, now that the porous membrane 51 is still in its wet state also in this position the mixture of liquid sample and hybridization buffer will remain in contact with the porous membrane 51. The person skilled in the art will appreciate that by suitable controlling the pressure supply means 14*a* and 14*b* it is possible to force the mixture of liquid sample and hybridization buffer back and forth through the membrane 51 while remaining in contact therewith. This has the advantage that more of the amplified target DNA can bind to hybridization probes provided in the porous membrane 51 having a complimentary structure and, thus, can provide for a stronger detection signal.

The valves which can be provided allow for controlling the flow of the air and the flow of the liquid sample. For example with a closed valve on port 35 and an open valve on port 34 (which is in connection with the external or ambient pressure), an underpressure of −150 mbar and an overpressure of +150 mbar is applied on port 36 in an alternate manner. Therefore, a sufficient pressure differential can be provided as desired.

According to the present invention, the mixture of liquid sample and hybridization buffer is preferably moved at least 5 times, most preferred at least 10 times through the porous membrane 51. At some point saturation will set in so that further movements of the mixture of liquid sample and hybridization buffer through the porous membrane 51 will not provide for a significant improvement of the signal to be detected. According to a preferred embodiment or preferably, a temporal break is made between two subsequent movements of the mixture of liquid sample and hybridization buffer through the membrane 51. Preferably, a break of about 10 to 60 seconds is made.

As a further step of the method according to the present invention the porous membrane 51, through which the mixture of liquid sample and hybridization buffer has been moved at least once, is optically analyzed by means of the optical excitation and detection means 18. In order to reduce stray light to a minimum it is preferred according to the present invention that for optical analysis of the porous membrane 51 the mixture of liquid sample and hybridization buffer is substantially in the position shown in FIG. 3*b*, i.e. within the internal fluid channel defined by the spacer element 42 or "below" the porous membrane 51 (after having passed at least twice through the membrane 51).

The reaction vessel 20 according to the present invention can be configured as a disposable unit for a one time use or, alternatively, the porous membrane 51 of the reaction vessel 20 could be a replaceable unit so that the reaction vessel 20 according to the present invention can be used more than once.

As the person skilled in the art will appreciate, the reaction vessel 20 of the PCR device 10 according to the present invention does not require any internal valves, which often are difficult to control, as the functions thereof are advantageously provided essentially by the porous membrane 51 of the reaction vessel 20 and its different physical properties in the dry state and the wet state.

Figure 4A:
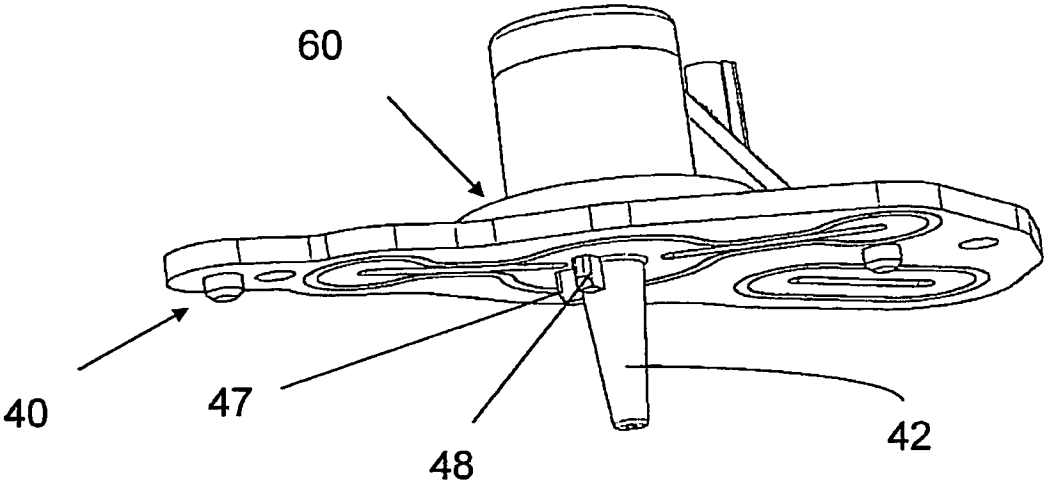
FIGS. 4*a* to 4*c* show different views of the reaction vessel according to a further preferred embodiment of the present invention.
Figure 4B:
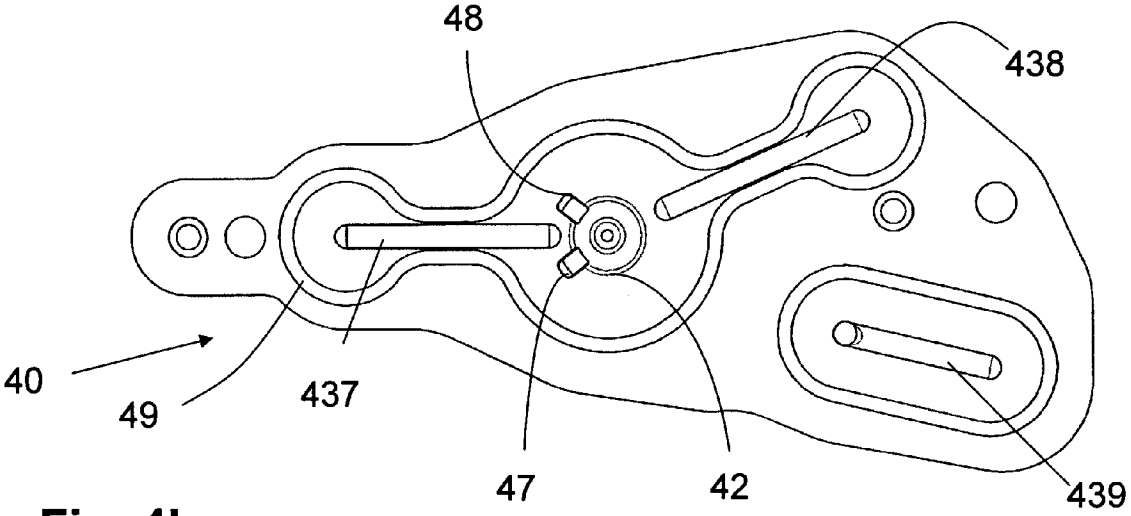
Figure 4C:
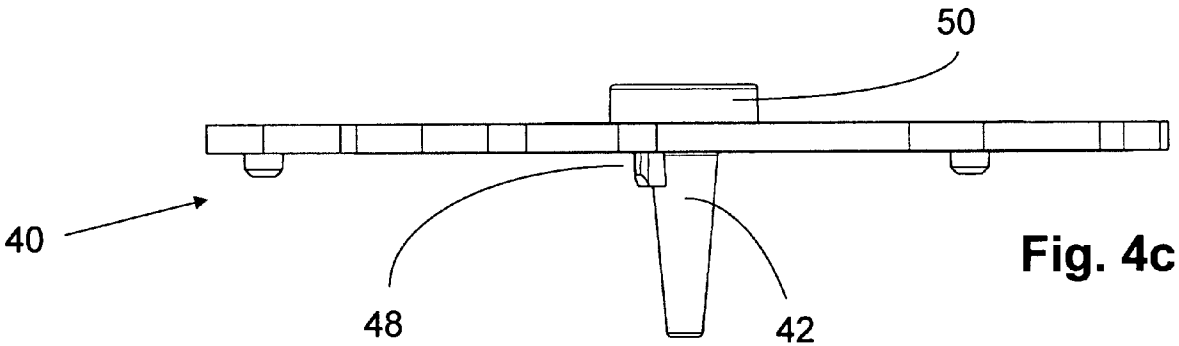

FIGS. 4*a* to 4*c* show different views of the reaction vessel according to a further preferred embodiment of the present invention. FIG. 4*a* shows a perspective view of the top element 60 and the center element 40 of the reaction vessel. FIG. 4*b* shows a bottom view of the center element 40 and FIG. 4*c* a side view. The reaction vessel 20 is similar to that of the embodiment described with FIGS. 1, 2*a* to 2*d* and 3*a* to 3*c*. An additional feature is provided, that is, guide members 47, 48 are provided, which are configured to guide the liquid sample supplied by the liquid supply port 34 into the reaction chamber 33. In particular FIGS. 4*a* and 4*b* show two guide members, while FIG. 4*c* only shows one of the guide members (the other one is arranged behind guide member 48).

The center element 40 preferably comprises additional grooves, first groove 437, second groove 438, third groove 439, which correspond to grooves 37, 38 and 39 in the bottom element 30 (see FIG. 4*b*). Once, the top surface of the bottom element and the bottom surface of the center element are fit together, the grooves of the bottom element and the grooves of the center element are aligned with each other and therefore, sufficient space is provided for supplying liquid or gas, in particular air. That is, the grooves can be provided my means of two groove halves (in the bottom element and in the center element) or by means of only one groove (either in the bottom element or in the center element).

Preferably, a welding support line or member 49 (or a plurality of welding support lines) is provided (see FIG. 4*b*) which allows for a proper welding when the bottom element and the center element are joined by welding. Such support lines are preferably also provided for joining the center element and the top element. The welding line melts during the welding and allows for a very strong and tight connection.

The grooves 437, 438 and 439 and the welding support line 49 can also be provided in the embodiment described with respect to FIGS. 1, 2*a* to 2*d* and 3*a* to 3*c*.

Each guide member is preferably configured as a nose, which is arranged at the spacer element 42, preferably at the upper end of the spacer element, and is directed towards the first groove 37, 437. In this embodiment, the guide member or guide members is/are formed as part of the center element 40, that is, the center element 40 comprises the spacer element and therefore, also the guide member(s).

The liquid sample inserted via the liquid supply port 34 is travelling through the groove 37 and/or 437 and is directed by the nose(s), that is guide member(s) 47, 48, to the bottom of the reaction chamber 33, wherein direct liquid transport (for example along the upper end of the spacer element 42) through the third groove 39 to the pressure port 35 is prevented. The undesired liquid transport can sometimes occur in case of high temperatures or when using surface-active substances.

The guide member can be configured in different manners which allow for directing liquid in a desired direction. It is possible to provide one or two guide members, but also a plurality of guide members can be provided. In this case, two guide members are sufficient to block the flow path of the liquid along the upper end of the spacer element.

Figure 5:
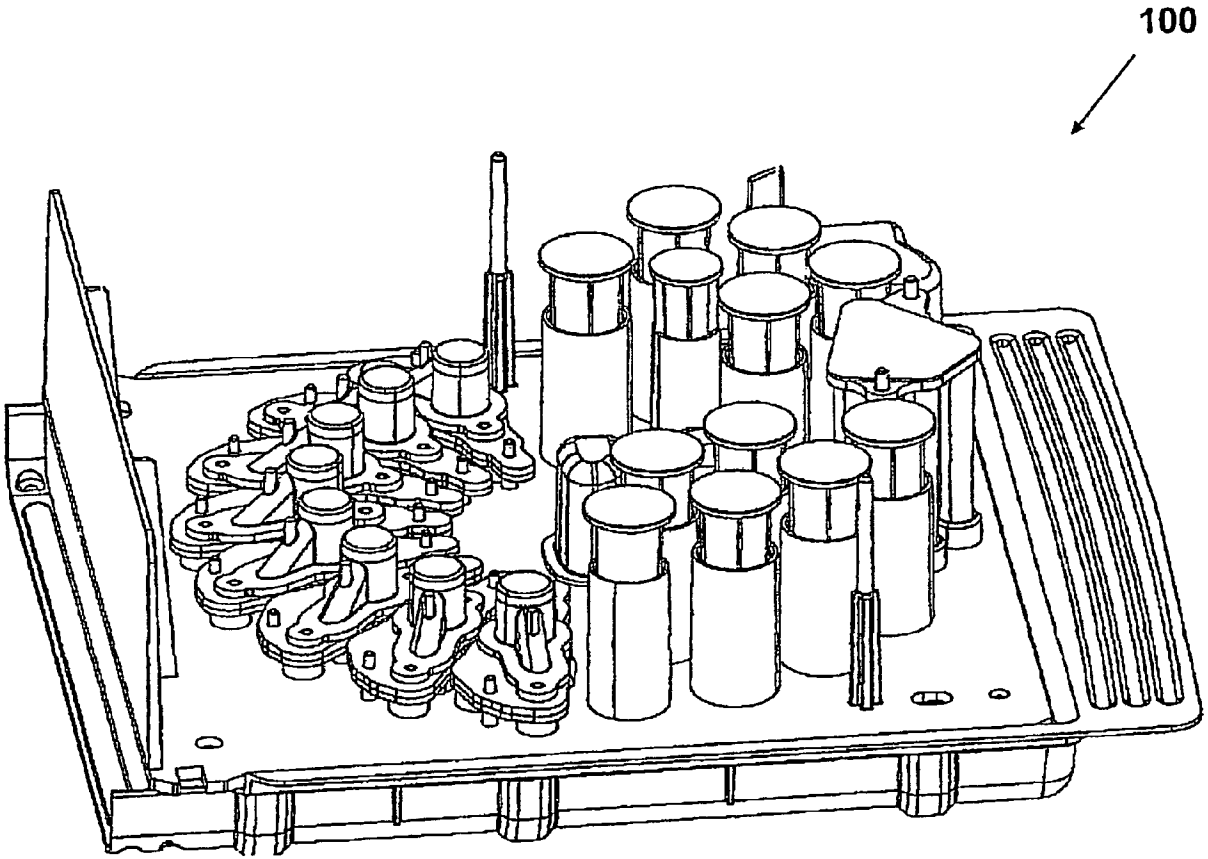
FIG. 5 shows a cartridge for use with a PCR device, wherein the cartridge comprises eight reaction vessels according to a preferred embodiment of the present invention.

FIG. 5 shows a cartridge 100 that could be part of a PCR device according to the present invention. As the person skilled in the art will appreciate from FIG. 5, more than one reaction vessel 20 according to the present invention can be advantageously used in such a cartridge as part of a PCR device providing for the appropriate fluidic connections and allowing for an optical interrogation of the respective porous membranes of the respective reaction vessels.

The present invention as described in detail above is not limited to the particular devices, uses and methodology described as these may vary. For instance, although the present invention has been described above in the context of a PCR device 10 including the reaction vessel 20, it may also be applied advantageously for the processing of samples other than by means of a PCR. Moreover, the person skilled in the art will appreciate that, in principle, the lower end of the spacer element 42 could be submersed in the liquid sample also by moving the spacer element 42 towards the liquid sample instead of "moving" the liquid sample relative to stationary spacer element 42 by dispensing an hybridization buffer and/or another reaction liquid into the reaction chamber 33, as described above. It is also to be understood that the terminology used herein is for the purpose of describing particular embodiments only, and is not intended to limit the scope of the present invention which will be limited only by the appended claims. Unless defined otherwise, all technical and scientific terms used herein have the same meanings as commonly understood by one of ordinary skill in the art.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integer or step.

Several documents are cited throughout the text of this specification. Each of the documents cited herein (including all patents, patent applications, scientific publications, manufacturer's specifications, instructions, etc.), whether supra or infra, are hereby incorporated by reference in their entirety. Nothing herein is to be construed as an admission that the invention is not entitled to antedate such disclosure by virtue of prior invention.

LIST OF REFERENCE SIGNS

10 PCR device
12*a*, 12*b* heating and/or cooling means
14*a*, 14*b* pressure supply means
16 liquid supply means
18 optical excitation and detection means

20 reaction vessel
30 bottom element
31 support plate
32 sample vial
33 reaction chamber
34 liquid supply port
35 first pressure port
36 second pressure port
37 first groove
38 second groove
39 third groove
40 center element
41 support plate
42 spacer element
43 membrane support
44 sealing element
45 pressure through-hole
46 assembly pin
47 guide member
48 guide member
49 welding support line
437 first groove
438 second groove
439 third groove
50 membrane element
51 porous hybridization membrane
52 membrane support skirt
60 top element
61 support plate
62 storage vessel
63 storage chamber
64 connection element
65 assembly hole
66 reference element
100 PCR cartridge

The invention claimed is:

1. A reaction vessel (20) for performing a polymerase chain reaction (PCR) and detecting amplified PCR products, the reaction vessel (20) comprising:

a reaction chamber (33) and a storage chamber (63) for receiving a liquid sample containing at least one target DNA;

a porous membrane (51) for hybridization of the at least one target DNA within the liquid sample onto at least one specific hybridization probe immobilised on the porous membrane (51); and a spacer element (42) extending into the reaction chamber (33) from below the porous membrane (51) but spaced from the bottom of the reaction chamber (33);

wherein the reaction chamber (33) and the storage chamber (63) are configured to be in fluid communication via the porous membrane (51) and a fluid channel defined by the spacer element (42) and wherein the membrane (51) is configured such that in a dry state the porous membrane (51) allows the passage of air or other gases as well as liquid therethrough and in a wet state the porous membrane (51) still allows the passage of liquid therethrough, but blocks the passage of air or other gases therethrough and wherein the reaction vessel (20) is configured such that during PCR the liquid sample remains in the reaction chamber (33) and after PCR the liquid sample can be forced via the spacer element (42) through the porous membrane (51) for hybridization and subsequent detection of the at least one target DNA in the liquid sample.

2. The reaction vessel (20) of claim 1, wherein the reaction vessel is configured to provide an overpressure in the storage chamber (63) and a vacuum or an underpressure in the reaction chamber (33) or to provide a vacuum or an underpressure in the storage chamber (63) and an overpressure in the reaction chamber (33), to move at least the liquid sample at least once, preferably at least five times, and most preferably at least ten times back and forth through the porous membrane (51) while remaining in contact therewith.

3. The reaction vessel (20) of claim 1, wherein the lower end of the spacer element (42) extends into the reaction chamber (33), but does not reach the bottom thereof, and wherein the upper end of the spacer element (42) is located in close proximity of and preferably in abutting relationship with the porous membrane (51).

4. The reaction vessel (20) of claim 3, wherein the distance between the lower end of the spacer element (42) and the bottom of the reaction chamber (33) is between 0.1 and 0.5 cm.

5. The reaction vessel (20) of claim 1, wherein the porous membrane (51) comprises a nylon material.

6. The reaction vessel (20) of claim 1, wherein the reaction chamber (33) is defined by a sample vial (32) provided as part of a bottom element (30) and/or the storage chamber (63) is defined by a storage vessel (62) provided as part of a top element (60).

7. The reaction vessel (20) of claim 6, wherein a center element (40) is provided, which is arranged or which is configured to be arranged between the top element (60) and the bottom element (30), and wherein the center element (40) preferably comprises the spacer element (42).

8. The reaction vessel (20) of claim 1, wherein the reaction chamber (33) is in fluid communication with a liquid supply port (34) for supplying the liquid sample containing at least one target DNA to the reaction chamber (33).

9. The reaction vessel (20) of claim 8, wherein the liquid supply port (34) is connected with the reaction chamber (33) by means of a first groove (37, 437).

10. The reaction vessel (20) of claim 8, wherein at least one guide member (47, 48) is provided, which is configured to guide the liquid sample supplied by the liquid supply port (34) into the reaction chamber (33).

11. The reaction vessel (20) of claim 10, wherein two guide members (47, 48) are arranged at the spacer element (42), preferably at the upper end of the spacer element, such that the liquid from the first groove (37, 437) is guided into the reaction chamber (33), and is prevented from further flowing along the upper end of the spacer element (42).

12. The reaction vessel (20) of claim 1 wherein the reaction vessel is configured to provide an overpressure in the storage chamber (63) and a vacuum or an underpressure in the reaction chamber (33) or to provide a vacuum or an underpressure in the storage chamber (63) and an overpressure in the reaction chamber (33), to move at least the liquid sample at least once, preferably at least five times, and most preferably at least ten times back and forth through the porous membrane (51) while remaining in contact therewith.

13. The reaction vessel (20) of claim 9, wherein at least one guide member (47, 48) is provided, which is configured to guide the liquid sample supplied by the liquid supply port (34) into the reaction chamber (33).

14. The reaction vessel (20) of claim 13, wherein two guide members (47, 48) are arranged at the spacer element (42), preferably at the upper end of the spacer element, such that the liquid from the first groove (37, 437) is guided into the reaction chamber (33), and is prevented from further flowing along the upper end of the spacer element (42).

15. A reaction vessel for performing a polymerase chain reaction (PCR) and detecting amplified PCR products, the reaction vessel comprising:

a reaction chamber for receiving a liquid sample containing at least one target DNA and a storage chamber above the reaction chamber;

a porous membrane for hybridization of the at least one target DNA within the liquid sample;

at least one specific hybridization probe immobilised on the porous membrane; and a spacer element extending into the reaction chamber from below the porous membrane, defining an internal fluid channel but spaced from the bottom of the reaction chamber;

the reaction chamber and the storage chamber being in fluid communication via the porous membrane and the fluid channel;

the membrane in a dry state allowing passage of air or other gases as well as liquid therethrough and in a wet state allowing only the passage of liquid therethrough; and the internal fluid channel having a volume which is less than volume of the reaction chamber below the spacer element.

* * * * *